US006959928B2

(12) United States Patent
Schultz

(10) Patent No.: US 6,959,928 B2
(45) Date of Patent: Nov. 1, 2005

(54) POKER-TYPE CARD GAME METHOD

(75) Inventor: Phillip C. Schultz, Walled Lake, MI (US)

(73) Assignee: MP Software Inc., Walled Lake, MI (US)

( * ) Notice: Subject to any disclaimer, the term of this patent is extended or adjusted under 35 U.S.C. 154(b) by 186 days.

(21) Appl. No.: 10/712,501

(22) Filed: Nov. 13, 2003

(65) Prior Publication Data

US 2005/0104292 A1 May 19, 2005

(51) Int. Cl.[7] ..... A63F 1/00
(52) U.S. Cl. ..... 273/292; 273/274
(58) Field of Search ..... 273/292, 274, 273/309; 463/12, 13

(56) References Cited

U.S. PATENT DOCUMENTS

| | | | | |
|---|---|---|---|---|
| 4,836,553 | A | 6/1989 | Suttle et al. | |
| 5,167,413 | A | 12/1992 | Fulton | |
| 5,288,081 | A | 2/1994 | Breeding | |
| 5,685,774 | A | 11/1997 | Webb | |
| 5,851,011 | A * | 12/1998 | Lott | 273/292 |
| 5,975,529 | A | 11/1999 | De Keller | |
| 5,984,308 | A | 11/1999 | Herrmann | |
| 6,045,130 | A | 4/2000 | Jones | |
| 6,345,823 | B1 | 2/2002 | Webb | |
| 6,443,456 | B1 | 9/2002 | Gajor | |
| 6,457,715 | B1 | 10/2002 | Friedman | |
| 6,474,646 | B1 | 11/2002 | Webb | |
| 6,536,768 | B2 | 3/2003 | Caputo | |
| 6,749,200 | B2 * | 6/2004 | Yurkins | 273/292 |
| 2002/0190469 | A1 * | 12/2002 | Conklin et al. | 273/292 |

* cited by examiner

*Primary Examiner*—Benjamin Layno
(74) *Attorney, Agent, or Firm*—Craig Weiss; Harry M. Weiss; Weiss, Moy & Harris, P.C.

(57) ABSTRACT

A poker-type game capable of providing a dealer with an initial advantage and a player with a subsequent advantage. From a predetermined number of cards, a dealer is assigned an initial hand having a greater poker value than an initial hand assigned to a player. Subsequently, a dealer receives a number of cards to complete the dealer's hand, and the player receives a number of cards to complete the player's hand, wherein a predetermined poker advantage is conveyed to the predetermined number of cards to complete the player's hand.

48 Claims, 1 Drawing Sheet

POKER-TYPE CARD GAME METHOD

BACKGROUND

1. Field of Invention

This invention relates generally to card games and methods therefor and, more particularly, to a poker-type card game with mutually exclusive advantages for a dealer and at least one player.

2. Description of Prior Art

Casino poker games have been popular since the late 1980's when the games "Carribean Stud" (disclosed in U.S. Pat. No. 4,836,553 to Suttle, et al in 1989), "Double Down Stud" (disclosed in U.S. Pat. No. 5,167,413 to Fulton in 1992), and "Let It Ride" (disclosed in U.S. Pat. No. 5,288,081 to Breeding in 1994) were introduced. Later, "Three Card Poker" (disclosed in U.S. Pat. No. 5,685,774 to Webb in 1997), was also introduced. These are the four most popular casino poker games today.

While these four games enjoy the most commercial success, at least a hundred new casino poker games have been patented since the 1980's. Described below are eight of these new games that provide insight into the broad categories into which these new games fit.

The first, disclosed in U.S. Pat. No. 5,984,308 to Hermann in 1999, combines poker with a game of blackjack. This game is from a group of games that blend poker with some other familiar casino game. A second game, disclosed in U.S. Pat. No. 5,975,529 to de Keller in 1999, is from a group that uses competition among players for a Pot award. A third game, disclosed in U.S. Pat. No. 6,345,823 to Webb in 2001, is from a group using wild cards. A fourth game, disclosed in U.S. Pat. No. 6,474,646 also to Webb in 2002, is from a group in which the player competes against a hand dealt to a dealer or the house. A fifth game, disclosed in U.S. Pat. No. 6,536,768 to Caputo in 2003, is from a group in which the player's final poker hand is compared to a group of winning hands in a pay table to determine awards. A sixth game, disclosed in U.S. Pat. No. 6,443,456 to Gajor in 2002, is from a group in which the physical arrangement of cards on the playing surface determines winning combinations. A seventh game, disclosed in U.S. Pat. No. 6,457,715 to Friedman in 2002, is from a group which involve draw poker—as opposed to stud poker which is far more common for casino poker games. Finally, an eighth game, disclosed in U.S. Pat. No. 6,045,130 to Jones and Suttle in 2000, is from a group that disclose only elements of a game—as opposed to complete games. This particular patent describes progressive jackpot payouts to players holding select poker hands.

As mentioned above, there are more than 100 new poker-based game patents, some of which combine elements of the aforementioned eight types. However, these eight encompass the major new Prior Art in casino poker games, and these eight will be discussed again below.

One reason for these new games is that inventors are trying to overcome a fundamental problem with the four well established games, "Double Down Stud", "Caribbean Stud", "Let It Ride" and "Three Card Poker". This problem is that these games do not supply high-quality hands frequently enough to hold most player's interest. High-quality hands are defined here as Straight's, Flush's, Full House's, Four's of a Kind, Straight Flush's and Royal Flush's. These are the hands that every poker player covets, and getting one of these hands provides a player with a heightened level of enjoyment. One example of a high-quality hand is a five-card Royal Flush, the highest of all poker hands. In five-card stud, it occurs, on average, once in 649,740 hands—an exceedingly rare event. Another example is Four of a Kind which, although less rare, occurs on-average once in every 4165 hands. Overall, a high-quality hand of some kind occurs in these five-card stud games only once in every 133 hands dealt, or about once in every three hours of table play in a casino. This frequency is not great enough to hold the interest of many recreational gamblers. For this reason, many newly-patented games feature higher award frequencies to hold players' interest. As will be shown, however, the rarity of high-quality hands is not the only deficiency in these four well established games.

In the game "Let It Ride" (U.S. Pat. No. 5,288,081 to Breeding), lack of high-quality hands causes players to encounter losing streaks which, while mathematically predictable, can be very discouraging, and lead to a player quitting the game. Overall, a player will lose 76% of all "Let It Ride" hands. This loss rate is due to: (1) the rarity of high-quality hands; and (2) the inventor's selection of which hands would receive awards. For example, Breeding could have increased the win rate by paying awards for pairs that are lower than a Pair Of 10's, which is the lowest hand that he selected for award payouts. With only a 24% win rate, the main attraction of this game is a player's option to double or triple the basic bet after seeing a partial hand that is already a winner or looks promising. Therefore, the main drawbacks of the game "Let It Ride" are: (1) the rarity of high-quality hands; and (2) a low 24% win rate due, in part, to Breeding's paytable selection.

In the game "Caribbean Stud" (U.S. Pat. No. 4,836,553 to Suttle et al), a player will, on average, lose about 65% of all hands, an improvement over 76% for "Let It Ride". However, over 40% of the "Caribbean Stud" player's awards are greatly reduced because the dealer's hand is said to not 'qualify'. The dealer must have a hand of Ace-King or higher in order for the player to receive maximum winning hand awards. The dealer not 'qualifying' is a historic source of player dissatisfaction with this game, since a player with a high-quality hand is unhappy to find it is awarded only a fraction of its value because the dealer's hand did not 'qualify'. Additionally, expert strategy dictates that the player will fold over 47% of all hands and simply lose his/her Ante to the house. Folding and losing one's Ante on over 47% of the hands makes this game even more discouraging. To summarize, drawbacks of "Caribbean Stud" are: (1) the requirement for the dealer's hand to 'qualify'; (2) expert strategy suggests the player fold over 47% of all hands and simply surrender the Ante wager to the house; and (3) the rarity of high-quality poker hands.

Both "Let It Ride" and "Caribbean Stud" have introduced an entertaining one-dollar optional side wager that can pay very high jackpot awards, in the $100,000 range, for a five-card Royal Flush. This award is possible because the odds of a Five-Card Royal Flush are 649,740-to-1. Other high-quality hands also receive jackpot awards. While this popular option adds more suspense to these games, "Let It Ride" and "Caribbean Stud" still suffer the drawbacks noted above.

In the game "Double Down Stud" (U.S. Pat. No. 5,167,413 to Suttle), high-quality hands occur at exactly the same rate as "Let It Ride" and "Caribbean Stud"—only 0.75%, or once every 133 hands. This low frequency does not attract many players. Also, a player will lose an average of 66% of all hands, which is about the same as "Caribbean Stud" but an improvement over "Let It Ride". The loss rate is improved over "Let It Ride" because Suttle's paytable starts at a pair of 7's (vs. Breeding's pair of 10's). The attraction of this game is a player's option to double the basic bet after seeing the first four cards out of a five-card hand. "Double Down Stud" does not offer a side wager with the very high awards for rare hands, as is with "Let It Ride" and "Caribbean Stud". To summarize, drawbacks of "Double Down Stud" are: (1) the rarity of high-quality hands; and (2) the lack of a side wager with very high payoffs for rare poker hands.

In the game "Three Card Poker" (U.S. Pat. No. 5,685,774 to Webb), there are two independent wagering propositions. The first, designated "Pair Plus", is based solely on the poker value of the three cards dealt to the player. This wager involves absolutely no player skill or decision-making and the player will, on average, lose 74% of these wagers. This is virtually the same disadvantage suffered by "Let It Ride". Additionally, the no-skill aspect of this proposition discourages players who like games requiring player decisions.

The second proposition, designated "Ante/Play", pits the player's three cards against the dealer's three cards in a showdown. The player wins if his/her hand is higher than the dealer's hand. Similar to "Caribbean Stud", the "Ante/Play" proposition requires the dealer's hand to 'qualify' in order for a showdown to take place. This, again, is a source of continual player dissatisfaction because player awards are reduced for, on average, 46% of a player's winning hands. Although the dealer's hand must 'qualify' for the "Ante/Play" showdown to take place, a nominal bonus, as high as 5-to-1, is paid for three high-quality player hands, whether the dealer qualifies or not. Nonetheless, the dealer 'qualify' requirement is a drawback of the "Ante/Play" wager. Also, expert strategy dictates that the player will fold 33% of all Ante/Play hands and surrender his/her Ante to the house. Consequently, the "Ante/Play" wager can be somewhat discouraging due to the necessity to fold 33% of all hands, which will result in losing one's Ante wager to the house and getting no wagering 'action' in return.

"Three Card Poker" does not offer a side wager with the very high awards for rare hands, as does "Let It Ride" and "Caribbean Stud". This is probably because: (1) there are already two wagering options in the game and adding a third option possibly could confuse some players; and (2) "Three Card Poker" is based on three-card poker hand rankings in which the highest quality hand is a Three-Card Straight Flush. This hand occurs, on average, every 460 hands. So, with a typical one-dollar side wager, the true-odds payoff if $460 is nowhere near the $100,000-level awards for a Five-Card Royal Flush in "Let It Ride" and "Caribbean Stud".

To summarize, drawbacks of the game "Three Card Poker" are: (1) the high rate of player losses in the "Pair Plus" wager; (2) the requirement for the dealer to 'qualify' in the "Ante/Play" wager; (3) the expert strategy which compels players following the strategy to fold 33% of all "Ante/Play" wagers; and (4) the lack of any side wager paying very high awards for rare poker hands.

The above examinations of "Double Down Stud", "Caribbean Stud", "Let It Ride" and "Three Card Poker" obviously require detailed mathematical analysis and an expert playing strategy for each game. These analyses and strategies have been published for these games; although, they are not contained in the patent documents themselves. To the inventor's knowledge, none of the eight recently-patented poker games described briefly above have had similar mathematical analyses and optimum strategies published. Nor is this information published in the patent documents themselves. Consequently, it is not possible to assess how well these games remedy the noted shortcomings of the four established games. However, each of the eight recently patented games was analyzed using patent documents and the following drawbacks were observed.

First, the game in U.S. Pat. No. 5,984,308 (to Herrmann) uses decidedly non-standard additions to the game of poker, this being Blackjack or "21". Most traditional poker players would dislike this mixing of games, yet other players would be confused by it. For traditional poker players, there is enough diversity in poker hands to provide a lifetime of enjoyment. For this group of players, introducing another unrelated game is undesirable and unnecessary. For other players the mixing of games would be confusing.

Second, the game in U.S. Pat. No. 5,975,529 (to de Keller) would be very hard, or impossible, to administer in a casino poker setting because more than one player is required for the game, and this is not always possible, especially when a game is just getting started or is breaking up. Additionally, since competition between players is involved, the potential for emotional outbreaks between players exists. Both of these factors would make the game very difficult to administrate.

Third, the game in U.S. Pat. No. 6,345,823 (to Webb) uses a wild card—apparently to increase the frequency of winning hands. Wild cards are a well-known method of increasing winning hand frequency, so their use is nothing new. Invariably, traditional poker players avoid wild card games, viewing them as family-entertainment poker and not worthy of serious attention. Also, casinos would not want to deal this game because pit personnel would have the daunting task of separating card decks that have Jokers from card decks that do not have Jokers. In summary, any wild card game would likely have only limited appeal to traditional poker players and be disliked by casino managers.

Fourth, the game in U.S. Pat. No. 6,474,646 (to Webb) requires the player and the dealer, to sort cards in their hands into HIGH, MID and LOW groupings. There is then a player-dealer showdown for each grouping. This sorting requires more mental attention and effort than many recreational players would want to devote. Also, the inventor discusses at length the occurrence of "copy" hands, or tie hands. The relatively high occurrence of these hands, relative to other poker games, is an additional problem with this invention. Poker players do not view "copy" hands, or tie hands, as an expected outcome or a satisfying conclusion to a poker showdown since, in traditional poker games, these are exceedingly rare.

Fifth, the game in U.S. Pat. No. 6,536,768 (to Caputo) is fundamentally a game of "Let It Ride" poker with the additions of: (1) a sixth card which the player has the option of purchasing with an optional upfront wager; and (2) jackpot awards that are progressive instead of the fixed awards which are integral to "Let It Ride". One difficulty with this invention is that it requires the casino dealer to continually use two pay tables that are very similar. One of these is for players not purchasing the sixth card and another for players that do purchase the sixth card. These pay tables have to be different because winning hand probabilities are greatly different. As a result, this game would be difficult to administrate. There is also a problem for the casino in that part of each optional wager must fund the progressive jackpot and part of it must fund the basic "Let It Ride" pay table. Since the inventor does not explain how this ratio is derived, game administration would be hampered until a suitable ratio was developed.

Sixth, the game in U.S. Pat. No. 6,443,456 (to Gajor) is a game in which the physical arrangement of cards on a playing surface determines winning hands. This game is only suited for video poker gaming since five or more poker hands are presented for analysis during each hand for each player. In a table poker game setting, this task would be far too great for a dealer on a consistent basis. Also, handling the great number of cards would quickly tire a dealer. Further, in the stud poker application of this invention, no player strategy exists. This is because, aside from the initial wager amount, the player makes no other decisions. Somewhat like a bingo game, cards are simply dealt and evaluated. This game would definitely not appeal to traditional poker players who expect and enjoy strategy and decision-making.

Seventh, the game in U.S. Pat. No. 6,457,715 (to Friedman) is a game of draw poker in which the player may replace zero, one or two of an initial two-card hand. Then a third card is dealt and winning hands are selected from a pay table. This game essentially mixes the games of draw poker, evidenced in the discard and replace stage, and stud poker, evidenced by dealing the third card. It is not likely that traditional poker players would accommodate this mixing of game types. In each game type individually, there is enough diversity and richness to satisfy traditional poker players. As such, to this group, mixing two game types appears unnecessary and undesirable.

Eighth, U.S. Pat. No. 6,045,130 (to Jones and Suttle) uses progressive jackpots for rare poker hands. These jackpots have been acknowledged above to increase player interest; so these patents verify a previously acknowledged strong point in the existing game "Caribbean Stud".

To summarize, the eight recently-patented casino poker games use either: (1) non-standard additions that would discourage, confuse and drive off many recreational players; (2) content that would be hard to administer in a casino table game setting; (3) content likely to have very limited appeal to traditional poker players; or (4) jackpots which have been previously acknowledged to increase player interest and anticipation.

Relative to the above games, the inventor sees an unfilled need for a new poker-type game that avoids the shortcomings of existing games. This new game should have: (1) more frequent high-quality poker hands; (2) a higher player win rate; (3) no requirement for a dealer's hand to 'qualify'; and (4) involve the player strategically in all hands dealt, i.e., the player always makes a strategy decision and never folds. In addition, this new game should: (5) offer very large payoffs for rare high quality poker hands; and (6) be easy to administer.

SUMMARY OF INVENTION

The basic game is showdown poker between at least one player's hand and a dealer's hand. Early in the game, this new method always gives the dealer's hand preferred treatment; consequently, a dealer's initial/partial hand is always more valuable than the player's initial/partial hand. However, later in the game, the dealer's advantage is partially or totally offset by a second specific game action that always favors the player's hand. This second action gives the player's hand the reasonable opportunity to beat the dealer's hand in a showdown. These two actions provide reciprocal advantages-initially only to the dealer, then finally only to the player.

This new method of reciprocal dealer-player advantages is, to the inventor's knowledge, original and has never been seen before in any game. In all games that are fair, there are reciprocal opportunities, or advantages, for both a player and an opponent. However, this invention is novel in that the dealer is given a unique and exclusive advantage early in the game, and this advantage guarantees the dealer a superior early position relative to the player. Then later in the game, the player is also granted a unique and exclusive advantage which gives the player the chance to recover from the initial shortfall and win the game. As will be shown, this method provides the basis for a plurality of embodiments of a new and useful poker game with exceptional suspense, surprise and player enjoyment.

BRIEF DESCRIPTION OF THE PREFERRED EMBODIMENTS

In accordance with one embodiment of the present invention, a method of playing a poker-type card game is disclosed, comprising, in combination the steps of dealing an initial predetermined number of cards, identifying a first subgroup of the initial predetermined number of cards having a relatively high poker value as compared to a remaining number of the initial predetermined number of cards not in the first subgroup, assigning the first subgroup having a higher poker value to a dealer as an initial dealer hand, assigning the remaining number of the predetermined number of cards not in the first subgroup to at least one player as an initial player hand, dealing a predetermined number of cards to the dealer to complete the dealer hand, dealing a predetermined number of cards to the at least one player to complete each the at least one player hand, conveying a predetermined poker advantage to the predetermined number of cards dealt to the at least one player to complete each the at least one player hand relative to the predetermined number of cards dealt to the dealer to complete the dealer hand, wherein the poker advantage being at least one of a greater number of cards, cards having a higher poker value, and the at least one player having a selection choice of the cards, comparing the completed poker hand value of the completed dealer hand with the completed poker hand value of each the completed player hand of each the at least one player, and selecting as a winning hand whichever of the dealer hand and each the at least one player hand that has a higher poker value.

In accordance with another embodiment of the present invention, a method of playing a poker-type card game is disclosed, comprising, in combination the steps of dealing an initial predetermined number of cards, identifying a first subgroup of the predetermined number of cards having a relatively high poker value as compared to a remaining number of the predetermined number of cards not in the first subgroup, assigning the first subgroup having a higher poker value to at least one player as an initial player hand, assigning the remaining number of the predetermined number of cards not in the first subgroup to a dealer as an initial dealer hand, dealing a predetermined number of cards to the dealer to complete the dealer hand, conveying a predetermined poker advantage to the predetermined number of cards dealt to the dealer to complete the dealer hand relative to the predetermined number of cards dealt to the at least one player to complete each of the at least one player hand, wherein the poker advantage being at least one of a greater number of cards, cards having a higher poker value, and the dealer having a selection choice of the cards, comparing the completed poker hand value of the completed dealer hand with the completed poker hand value of each the completed player hand of each the at least one player, and selecting as a winning hand whichever of the dealer hand and each the at least one player hand that has a higher poker value.

In accordance with yet another embodiment of the present invention, a poker-type card game table is disclosed, comprising, in combination a table having a dealer hand area dimensioned to receive at least one playing card and at least one player hand area dimensioned to receive at least one playing card, and a plurality of individual betting locations located proximate an outer perimeter of the table, each of the individual betting locations having: an ante wagering area designated for wagering a first amount that a completed player hand will have a higher poker value than a completed dealer hand, a bet wagering area designated for wagering a second amount that a completed player hand will have a higher poker value than a completed dealer hand, and a raise wagering area designated for wagering a third amount that a completed player hand will have a higher poker value than a completed dealer hand.

In accordance with yet another embodiment of the present invention, a method of playing a combination blackjack and poker-type card game is disclosed, comprising, in combination the steps of dealing at least one player blackjack hand to at least one player, dealing a dealer blackjack hand to a dealer, comparing the at least one player blackjack hand to the dealer blackjack hand, selecting as a winning hand whichever of the dealer blackjack hand and each the at least one player blackjack hand that has a higher blackjack value, one of dealing, removing and not dealing at least one card to the at least one player blackjack hand to achieve a first initial poker hand of three cards, one of dealing, removing and not dealing at least one card to the dealer blackjack hand to achieve a second initial poker hand of three cards, comparing the initial poker hand value of the first hand with the initial poker hand value of the second hand, assigning whichever of the first hand and the second hand that has a higher initial poker hand value to a dealer as an initial dealer hand, assigning whichever of the first hand and the second hand not assigned to the dealer to the at least one player as an initial player hand, dealing the dealer two additional cards to complete the dealer hand, determining a completed five-card poker hand value of the dealer hand based on the initial dealer hand of three cards and the two additional cards dealt to the dealer, dealing each the at least one player additional cards to complete the player hand, conveying a predetermined poker advantage to the predetermined number of cards dealt to the at least one player to complete each the at least one player hand relative to the predetermined number of cards dealt to the dealer to complete the dealer hand, wherein the poker advantage being at least one of a greater number of cards, cards having a higher poker value, and the at least one player having a selection choice of the cards, comparing the completed poker hand value of the completed dealer hand with the completed poker hand value of each the completed player hand of each the at least one player, and selecting as a winning hand whichever of the dealer hand and each the at least one player hand that has a higher poker value.

OBJECTS AND ADVANTAGES

An object of the present invention is to provide a method of playing a poker-type card game capable of providing a dealer with an initial, exclusive advantage and at least one player a subsequent, exclusive advantage. This method, as described above and in the claims, provides novel entertainment in that a player's hand is always at an initial disadvantage relative to a dealer's hand. However, each player is assured that, by the end of the game, the player's hand will enjoy an offsetting advantage relative to the dealer's hand. If cards then fall favorably, the player's final hand will beat the dealer's final hand in a showdown. This unique and novel method will provide players with a distinctively new, entertaining and suspenseful poker game.

Another object of this invention is to provide a new game that overcomes the inherent disadvantages of existing house-banked poker games. This object is fulfilled by a carefully designed line of play which, compared to existing games: (1) yields more high-quality poker hands; (2) has a very high percent of winning player wagers; (3) involves a mentally-stimulating expert strategy; (4) has no requirement for a dealer's hand to 'qualify'; (5) puts the player in-action to the conclusion of every hand, i.e., the player never folds; (6) provides very high jackpot awards for very rare hands; (7) is easy for a casino to administer; and (8) does not mix poker with any other game, i.e. contains only poker card combinations. These are explained further below:

More High-Quality Poker Hands: All poker players enjoy being dealt high-quality hands, which were defined above as five-card Straight's, Flush's, Full House's, Four's of a Kind, Straight Flush's and Royal Flush's. Due to the five-card format of "Double Down Stud", "Caribbean Stud" and "Let It Ride", these hands occur, on average, only 0.75% of the time—about one high-quality hand per 133 hands dealt. However, in this new game, the player forms the best five-card hand out of a six-card hand. The sixth card increases the frequency of high-quality hands by a factor of 4.4-to-1 verses a five-card format. So, on average, there is one high-quality hand for every 30 hands dealt. The increase in high-quality hands provides this new game a significant advantage over five-card based poker games.

Higher Percent Of Winning Wagers: This new game, in its preferred embodiment, features an overall player win rate for an initial wager of approximately 49%. This win rate is higher than any other house-banked stud poker game for which such information has been published. Specifically, the expert strategy win frequency for the basic bet in "Double Down Stud" is 33%, "Caribbean Stud" is 37% and "Let It Ride" is 24%. The win frequency for the "Three Card Poker" Pair Plus wager is 26% and the Ante/Play wager is 45%. With a 49% win frequency, this new game has a significant advantage over the games "Caribbean Stud", "Double Down Stud", "Let It Ride" and the "Three Card Poker" Pair Plus wager, and a marginal advantage over the "Three Card Poker" Ante/Play wager.

Skill, Strategy and Player Decision: A player's decision whether to place the optional second wager (in the preferred embodiment) requires a moderate degree of skill. This skill requirement will attract players who enjoy games containing player decisions. These players normally wager on Blackjack, table poker or sporting events, due to the player decisions these wagers require. The expert strategy for this new game, however, is approximately as complex as Blackjack but not nearly as complex as expert strategies for table poker and sports wagers. In contrast, existing house-banked poker games such as "Double Down Stud", "Let It Ride", "Caribbean Stud" and "Three Card Poker" have relatively simple expert strategies. Consequently, the moderate skill element of this new game will attract another new group of players to casino-banked poker games.

No Requirement For Dealer To 'Qualify': In this new game, there is no need for the dealer's hand to 'qualify' in order for a showdown to take place, as is the case with the games "Caribbean Stud" and "Three Card Poker". In these games, the requirement to 'qualify' is a historic source of player dissatisfaction because a player's winning hand must accept a reduced payoff when the dealer's hand does not 'qualify'. Since the preferred embodiment of this new game has no such rule, it has a significant advantage over the two aforementioned games.

Player Is Actively Involved In Every Hand And Never Folds: In the preferred embodiment, this new game requires the player, upon viewing two partial poker hands, to make a decision on whether or not to make a second wager (in addition to the initial wager). Since the player does not have the option to fold, the player is fully engaged in the game to its conclusion, irrespective of the above decision. A decision to place a second wager, however, makes the game even more engaging. The fold option is integral to the games "Caribbean Stud" and "Three Card Poker". In these games, expert strategy requires a player to fold 33%–47% of all hands. This results in 33%–47% dead time for skilled players, since they must wait while the hands of other players are played to conclusion. This dead time deprives players of desired wagering action. Consequently, this new game enjoys a player involvement advantage over the games "Caribbean Stud" and "Three Card Poker".

Very High Awards Possible: With the optional bonus wager, a six-card Royal Flush (i.e. Ace–Nine in the same suit) can easily pay an award of $1,000,000 for a one-dollar wager. This award is much larger than for five-card Royal Flush's in current games. Awards for a five-card Royal Flush (i.e. an Ace–Ten in the same suit), are typically $100,000 or less for a one-dollar wager. The $1,000,000 payoff for the six-card Royal Flush is possible because the mathematical probability of a six-card Royal Flush is, on average, one in 5,089,630 hands. In contrast, any game using the five-card format could not offer a Royal Flush award of $1,000,000 without a financial loss to the casino. This is because the mathematical probability of a five-card Royal Flush is, on average, one in 649,740 hands. A $1,000,000 maximum award payoff for this new game presents a significant advertising advantage for casinos that will attract another new group players seeking games with lifestyle-changing payoffs.

Easy For Casino To Administer: First, there is only one round of player decision-making so there is less chance for dealer/player misunderstandings than games with multiple player decisions. Second, since this new game distributes cards in groups of three, it is ideally suited to the very efficient card-dealing machines now standard in many casinos. Finally, there is no requirement for more than one player to be at the table, so the game can always proceed.

Only Poker Card Combinations Are Used: The first group of newly-patented games in the Description Of Prior Art combine the game of poker with other casino games such as Blackjack, craps, etc. This mixing of games would probably discourage traditional poker players from playing the game and possibly confuse other players. The preferred embodiment of this new game enjoys an advantage over these games in that it relies only on poker card combinations such as Pairs, Straight's, Flush's, Full House's, etc.

These and other objects and advantages will become apparent to the reader from the Description Of Alternative Embodiments, the claims and the drawings.

DETAILED DESCRIPTION OF PREFERRED EMBODIMENT

Figure 1:
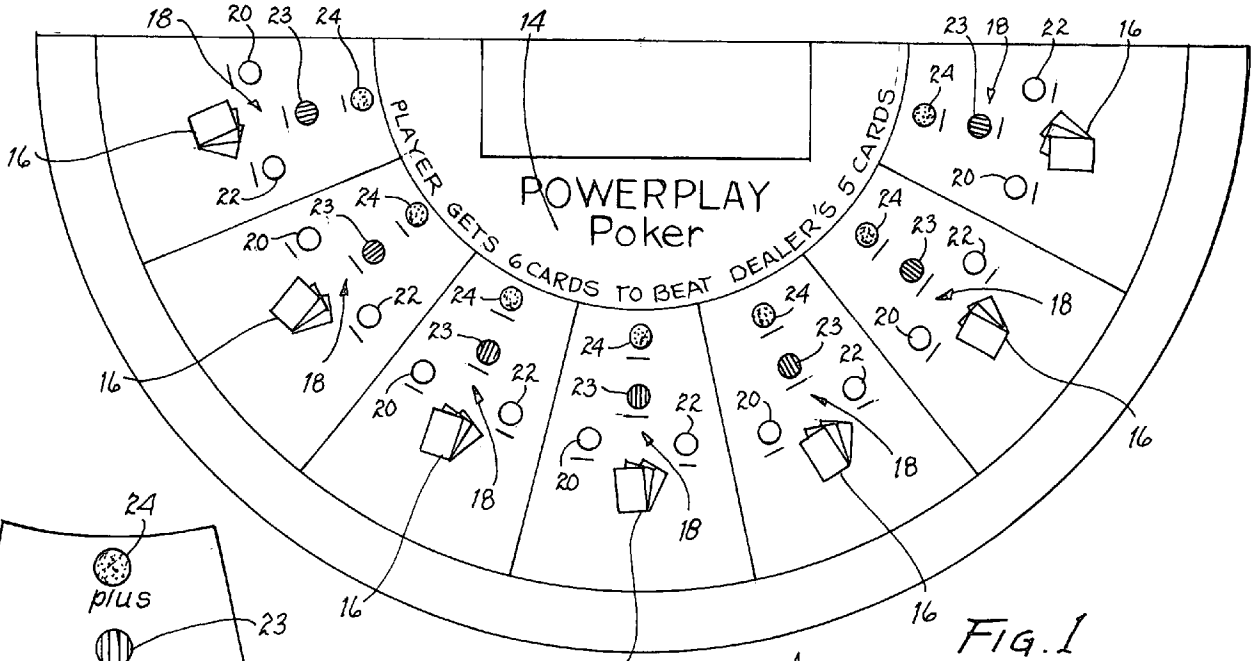
FIG. 1 is a top view of the preferred embodiment of the combined poker-type card game table of the present invention.

The present invention includes both a method of playing a poker-type card game and a table therefore (shown in FIG. 1). In the preferred embodiment, a game of stud poker is played, and the dealer is a casino dealer that represents the house or casino, however, it should be clearly understood that substantial benefit could be derived from an alternative embodiment of the present invention in which a game other than stud poker is played and/or in which the dealer is not a casino dealer.

The first step in the method of playing a poker-type card game is dealing an initial predetermined number of cards. In the preferred embodiment, this initial number of cards is six cards, dealt in two rows of three cards each, although it should be clearly understood that substantial benefit could be derived from an alternative number of initial cards. After the initial number of cards are dealt, a first subgroup (preferably 3 cards) is identified of the initial number of cards (preferably 6 cards) having a higher poker value as compared to a remaining number (preferably 3 cards) of the initial number of cards. This first subgroup is assigned to a dealer as an initial dealer hand and the remaining number of cards not assigned to the first subgroup is assigned to at least one player as an initial player hand. While, in the preferred embodiment, the initial poker value of the initial dealer hand is greater than the initial poker value of the initial player hand, it should be clear that substantial benefit could be derived from an alternative embodiment of the poker-type card game in which the initial poker value of the at least one player hand is greater than the initial poker value of the dealer hand.

In the preferred embodiment, each player is required to make an initial wager prior to the start of each hand of the poker-type game of the present invention. Preferably, this initial wager is split into two equal amounts known as "Ante" and "Bet" (see FIGS. 1 and 2). Also preferably, each player is permitted, at the player's discretion, to make a second wager before or after the assignment of the initial cards into a dealer hand and a player hand. This second wager, known as the "Raise" is preferably limited to one-half the amount of the first wager (or equal to the "Ante" or "Bet" portions), although it should be clearly understood that substantial benefit could be derived from an alternative embodiment of the poker-type card game of the present invention in which there is only a first wager and no second wager, or in which the second wager is not equal to one-half of the first wager, or in which additional wagers are allowed at various predetermined points in the game, or in which there is no wagering at all.

In the preferred embodiment, the poker value of the initial cards is determined by standard poker rules. If there are six initial cards grouped into two sets of three cards each, then each three-card hand is evaluated, preferably, by standard poker rules, without straights or flushes. For example, when comparing two three-card hands to one another the following rules preferably apply: 1) any three-card hand having a pair has a higher hand value than any three-card hand having three unmatched cards; 2) any three-card hand having three of a kind has a higher hand value than any three-card hand having a pair; 3) a three-card hand having a pair of higher poker value (e.g., a pair of Kings) has a higher poker value than a three-card hand having a pair of lower poker value (e.g., a pair of 10's); 4) a three-card hand having a higher three of a kind (e.g., three 7's) has a higher poker value than a three-card hand having a lower three of a kind (e.g., three 4's); 5) when both three-card hands have pairs of equal value then the three-card hand having a higher third card is the hand with the higher poker hand value; 6) if each three card hand has three unmatched cards then the hand with the highest card has a higher poker value; 7) if each three card hand has three unmatched cards and the highest card of each three-card hand is the same then the hand with the highest second card has a higher poker value; and 8) if each three card hand has three unmatched cards and the two highest cards of each three-card hand is the same then the hand with the highest third card has a higher poker value. In the event that all three cards of each poker hand are of equal poker value then there are several ways to determine which initial three-card hand is to be assigned to the dealer and which three-card hand is to be assigned to the player. One possibility is that the dealer could simply assign as the initial dealer hand whichever three-card hand is physically closer to the dealer. In one embodiment, if one three card hand has three cards of the same suit while the other does not, then the three-card hand with three cards of the same suit is assigned to the dealer, but if there is a three-card hand with two cards of the same suit and the other three card hand has three differently suited cards, then the hand having two cards of the same suit is assigned to the player. While, in the preferred embodiment, each three-card hand is compared according to the aforementioned criteria, it should be clearly understood that substantial benefit could be derived from an alternative embodiment of the poker-type card game of the present invention in which some other type of criteria is used, such as three-card straights and three-card flushes, or another variation of standard poker valuation is used for initial hands of more or less than three cards each, to compare and assign each three-card hand to a dealer and a player. For example, the dealer's hand may comprised of the two cards having the highest poker value of the six initial cards along with the one card having the lowest poker value of the six initial cards. The remaining three cards would then be automatically assigned to the at least one player.

In the preferred embodiment, each three-card hand of the six initial cards are dealt with two cards face-up and one card face-down. It is preferably at this time that each player is permitted to make a second wager (or "Raise") on the outcome of the game. After the player either makes a second wager or declines the option to make a second wager, the final card of each three-card hand is revealed and each hand is then evaluated and assigned to the dealer and to the at least one player. While, in the preferred embodiment, the three-card hands are dealt with two cards face-up and one card face-down it should be clearly understood that substantial benefit could be derived from alternative ways of dealing the initial predetermined number of cards, such as dealing all initially dealt cards face-up, or dealing only one of the initially dealt cards face-down, or dealing one three-card hand face-up while another is dealt face-down, or dealing only one card of each three-card hand face-up, or some other embodiment specifically designed for embodiments of the present invention in which the initial predetermined number of cards are more or less than six.

After the assignment of the initial cards to an initial dealer hand and an initial player hand, and after any player may or may not have placed any additional wager, a predetermined number of cards are dealt to the dealer to complete the dealer hand. In the preferred embodiment, in which the initial dealer hand comprises three cards, the dealer is dealt an additional two cards at this stage to give the dealer a completed five-card poker hand. However, it should be clearly understood that substantial benefit could be derived from an alternative embodiment of the poker-type card game of the present invention in which the dealer achieves a completed five-card poker hand by an alternative distribution of cards (e.g., receiving two cards as the initial dealer hand and then three cards subsequently to complete the dealer hand), or in which the completed dealer hand has more than five cards (and the five cards with the highest poker value comprise the dealer's completed poker hand value), or in which the completed dealer hand has less than five cards (and a separate poker valuation is used to determine the best three-card or four-card poker hand). For example, in one embodiment of the present invention, after the dealer receives a completed five-card poker hand, the dealer may then discard and replace a predetermined number of cards. After the player receives a completed five-card poker hand, the player may then discard and replace a predetermined number of cards, wherein the player may discard and replace a greater number of cards than the dealer.

After the dealer's hand has been completed, each player is then dealt a predetermined number of cards to complete the player's hand. In the preferred embodiment, the initial cards dealt are community cards to be used by all players whereas additional cards dealt to complete each player's hand are dealt individually to each player, although it should be clearly understood that substantial benefit could be derived from an alternative embodiment of the poker-type card game of the present invention in which both the initial cards and the completion cards are community cards to be used by all players, or in which both the initial cards and the completion cards are dealt individually to each player, or in which the initial cards are dealt individually to each player and the completion cards are community cards.

In the preferred embodiment, when the initial dealer hand and the initial player hand comprise three cards each, and when the dealer receives two additional cards to complete the dealer hand, each player receives three additional cards (to go with the player's three initial cards for a total of six cards) to complete the player hand. From these six cards, the player plays the best five-card poker hand. Thus, although in the preferred embodiment, the dealer enjoys the initial advantage of receiving an initial hand with a higher poker value than the player's initial hand, each player preferably receives the advantage of receiving at least one additional card with which to achieve a poker hand of a higher value. It should be clearly understood that substantial benefit could be derived from alternative distributions of cards so long as there is an initial advantage for the dealer (or alternatively for the player) in the form of the assignment of an initial hand having a higher poker value and a subsequent advantage for the player (or alternatively the dealer) in the form of at least one of: 1) receiving additional cards; 2) receiving cards having a higher poker value; and 3) having a selection choice over the additional cards. For example, it is within the spirit and scope of the invention to deal seven cards initially as two sets of three cards each and a seventh card to the side, and after the three-card hand with the higher initial poker value is assigned to the dealer, the seventh card is grouped with the player's initial three-card hand, and then both the dealer and each player receive two additional cards to complete each hand.

After both the dealer's hand has been completed and each player's hand has been completed, each player's hand is compared to the dealer's hand wherein the completed hand having the higher poker value is the winning hand. If there have been any wagers made by players, then each player's hand determined to be a winning hand is preferably awarded an amount equal to the wager made. Conversely, a wager is collected from each player having a hand determined to be of lesser poker value than the dealer's hand. In one embodiment of the poker-type card game of the present invention in which the player is required to make an initial wager to play the game and has the option of placing a second wager on the outcome of the game, the player's winning hand must have a poker value of a pair of 2's or greater in order to receive an amount equal to the first wager. In this embodiment, in the event that the player is determined to have a winning hand of less than a pair of 2's (or some other predetermined poker value) then the player is preferably awarded one-half the amount of the first wager (i.e. the "bet" portion of the first wager is awarded to the player but the "ante" portion is a push, neither being paid or collected). In the immediately preceding example in which a player is determined to have a winning hand of less than a pair of 2's (or some other predetermined poker value) and in which the player places the optional second wager, the player is nevertheless awarded a preferably even money award on the second wager. However, it should be clearly understood that substantial benefit could be derived from an alternative embodiment of the present invention in which there is no minimum poker value necessary to receive the second wager amount, or in which the minimum poker value necessary is a value other than a pair of 2's or better.

In the preferred embodiment, each player is also permitted to make a bonus wager in order to be eligible to receive a pre-determined bonus payout if the completed player hand (or the completed dealer hand) has a pre-determined poker value. As discussed above, a player could wager that his or her completed hand will be a Royal Flush, Straight Flush, Four of a Kind, etc. Additionally, if a casino included six-card hands in the bonus payoff structure, a six-card Royal Flush, which is Ace through Nine in the same suit, would be the highest ranking hand (a six-card hand is only possible for a player in the preferred embodiment, and is comprised of the initial three cards as well as the subsequently dealt three cards). This six-card Royal Flush has the potential for a $1,000,000 or higher award for a one-dollar bonus wager. This is possible because the odds for this hand are one in 5,089,630. As such, the bonus wager enhances the basic wagering aspect of the game by allowing a player to compete for a lifestyle-changing award. While, in the preferred embodiment, the player is permitted to make a bonus bet, it should be clearly understood that substantial benefit could be derived from an alternative embodiment of the present invention in which there is no bonus bet option.

In an alternative embodiment of the present invention, the poker-type card game is played between players, and not against a casino-banked dealer. In this embodiment, competition would be between players for a collective wagering pot, such as in the game Texas Hold'em. It is within the spirit and scope of this invention that a player be designated as the 'dealer/banker' and would pay out awards and collect losing wagers. In this alternative, the house would not be the banker, but the house would collect a fee from each player. This fee may be for a player actually dealing the cards and administrating the game or simply for the use of facilities. Like Hold'em, a dealer (or dealer/banker) position could be rotated around a table after successive games in order to equalize any advantage or disadvantage inherent to the dealer position.

In another embodiment of the present invention, an overall winner of the poker-type card game could be determined on the basis of an overall number of hands won, as opposed to determining winning and losing hands on the basis of each individually completed hand.

In another embodiment of the present invention, a game of blackjack is played between at least one player and a dealer. Then, retaining the blackjack cards, a player is dealt additional cards to complete a poker hand (preferably for a total of six cards). The dealer is also dealt additional cards to complete a poker hand (preferably for a total of five cards). In this way, although the dealer has the initial advantage with blackjack, the player has the subsequent poker advantage by receiving one more card than the dealer with which to achieve a best poker hand.

Figure 2:
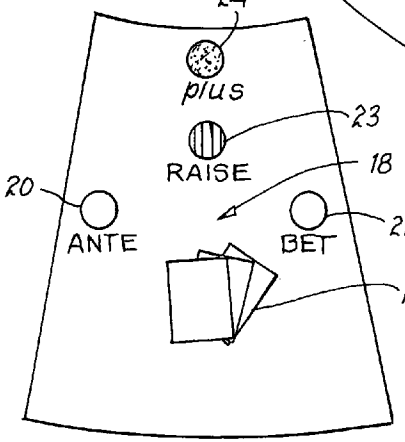
FIG. 2 is a top view of an individual betting location and player hand area of the poker-type card game table of the present invention.

Referring now to FIGS. 1 and 2, a poker-type card game table 10 (shown in FIG. 1) is shown. The poker-type card game table 10 comprises a table 12 (shown in FIG. 1) having a dealer hand area 14 (shown in FIG. 1) dimensioned to receive at least one playing card and at least one player hand area 16 dimensioned to receive at least one playing card. The poker-type card game table 10 further comprises a plurality of individual betting locations 18 located proximate each player hand area 16. Preferably, the poker-type card game table 10 comprises 7 betting locations 18, although it should be clearly understood that substantial benefit could be derived from an alternative embodiment of the poker-type card game table 10 in which the number of individual betting locations 18 deviates, even substantially, from the preferred number of betting locations, in either direction.

Still referring to FIGS. 1 and 2, each of the individual betting locations 18 has an "Ante" wagering area 20 designated for wagering on a player hand and a "Bet" wagering area 22 also designated for wagering on the player hand. Preferably, a first wager is split into two equal portions, one portion placed in the "Ante" wagering area 20 and the second portion placed in the "Bet" wagering area 22, although it should be clearly understood that substantial benefit could be derived from placing unequal amounts in the "Ante" wagering area 20 and the "Bet" wagering area 22. Each of the individual betting locations 18 further comprises a "Raise" betting area 23 designated for making a second wager amount on a player hand. Preferably, the "Raise" betting area 23 is limited to the amount placed in either the "Ante" wagering area 20 or the "Bet" wagering area 22 (i.e. preferably one-half of the total first wager amount). In the preferred embodiment, each of the individual betting locations 18 further comprises a "Plus" wagering area 24 designated for wagering that one of the player hand and the dealer hand will achieve a poker hand having a pre-determined poker value, although it should be clearly understood that substantial benefit could be derived from an alternative embodiment of the present invention in which the poker-type card game table 12 lacks a "Plus" wagering area 24 or has some other wagering area in its place. Preferably, the poker-type card game table 10 utilizes a single deck of playing cards, although it should be clearly understood that substantial benefit could be derived from the use of multiple decks of playing cards.

Referring now to FIG. 1, in the preferred embodiment, the poker-type card game table 10 further comprises a commercial name for the game 26 and some information 28 about the game to attract and inform players. A rectangle 30 above the game name 26 represents a chip tray for the dealer's use.

STATEMENT OF OPERATION

In the preferred embodiment, at least one player places a first wager that the player's completed poker hand will beat the dealer's completed poker hand in a showdown. The player has the option to place a bonus bet wager that the player's hand will achieve a poker hand having a predetermined poker value, regardless of whether or not the player's hand beats the dealer's hand.

The dealer then deals two three-card partial poker hands face-down on the table and immediately turns two cards face-up in each hand. At this point in the game, which partial hand will go to the dealer and which will go to the player has not been decided. The player may now place an optional second wager. The player will make this optional second wager feeling the exposed cards to be favorable. This optional wager is limited to one-half the amount of the first wager.

This decision now made, the dealer exposes the third card in each three-card hand and evaluates each hand's rank. In this evaluation, only high cards, pairs and three's of a kind are used. Thus, only for this partial hand evaluation, flush's and straight's do not count. Based on this evaluation, the highest ranking partial hand is assigned to the dealer as an initial dealer hand and the lowest ranking partial hand is assigned to the player as an initial player hand. It is this game action that always favors the dealer. At this point, the player's initial player hand is further designated as a set of community cards to be used by all other players participating in the game. As such, these community cards are placed centrally on the table so as to be visible to all players.

The dealer now deals two more cards face-up to the dealer's hand to form the dealer's completed five-card hand. Consequently at this point, the player knows the poker hand that must be beat in order to win the showdown, so the player's suspense, concentration and anticipation increase significantly. The dealer then deals three more cards to each individual player which the player combines with the three community cards to form a final six-card hand. The player receiving six cards, while the dealer receiving only five cards, is the game action that always favors the player. From this six-card hand, each player forms the best five-card poker hand and presents it for a showdown with the dealer's five-card hand. It is noted here that the player always must use at least two of the final three cards dealt to form a five-card hand. Consequently, the player's concentration is riveted on these cards and suspense is at a peak.

If the player's hand beats the dealer's hand, the player receives an even-money award on either the first wager or both wagers (if a second wager was made). To allow individual casinos to vary their profit margins, a given casino may elect to pay an even-money award on both the first wager and the second wager only if the player's winning hand is at least of a certain poker rank. In the preferred embodiment, the player is paid even-money on both the first wager and the second wager only if the player's winning hand contains at least a pair of 2's. If the player's winning hand is less that a pair of 2's, such as Ace-high, the player is paid even-money on one-half of the first wager (i.e. the "Bet" portion), and even money on the second wager. In the preferred embodiment, this payoff structure ensures the casino a long-term mathematical advantage of about two percent versus a player using perfect strategy when deciding to make the optional second wager. Individual casinos may decide on payoff structures that are either more or less liberal.

The bonus wager, which is settled independently of the first and second wagers, is resolved by comparing the player's final hand to the bonus wager pay table. This table lists increasing awards for increasingly rare poker hands. Thus, a Royal Flush would pay more than a Straight Flush, a Straight Flush would pay more than a Four of a Kind, and so forth. If a casino included six-card hands in the bonus payoff structure, a six-card Royal Flush, which is Ace through Nine in the same suit, would be the highest ranking hand. This six-card Royal Flush has the potential for a $1,000,000 or higher award for a one-dollar bonus wager. This is possible because the odds for this hand are one in 5,089,630.

Although the descriptions above contain many details, these details should not be interpreted to limit the scope of the invention. Rather, the details should reflect the diligence of the inventor in fully developing a commercially successful embodiment of the invention. Examples of broader applications of this invention include, but are not limited to, other styles of playing indicia, other types of gaming instruments such as dice, applications of the embodiments to video poker machines, video lottery terminals, commercial poker parlors, scratch off games, reel-type slot machines, internet gambling, bingo parlors and/or keno lounges, and casino blackjack-style tables using electronic displays of cards rather than actual playing cards.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A method of playing a poker-type card game comprising, in combination, the steps of:

dealing an initial predetermined number of cards;

identifying a first subgroup of said initial predetermined number of cards having a relatively high poker value as compared to a remaining number of said initial predetermined number of cards not in said first subgroup;

assigning said first subgroup having a higher poker value to a dealer as an initial dealer hand;

assigning said remaining number of said predetermined number of cards not in said first subgroup to at least one player as an initial player hand;

dealing a predetermined number of cards to said dealer to complete said dealer hand;

dealing a predetermined number of cards to said at least one player to complete each said at least one player hand;

conveying a predetermined poker advantage to said predetermined number of cards dealt to said at least one player to complete each said at least one player hand relative to said predetermined number of cards dealt to said dealer to complete said dealer hand, wherein said poker advantage being at least one of a greater number of cards, cards having a higher poker value, and said at least one player having a selection choice of said cards;

comparing said completed poker hand value of said completed dealer hand with said completed poker hand value of each said completed player hand of each said at least one player; and selecting as a winning hand whichever of said dealer hand and each said at least one player hand that has a higher poker value.

2. The method of claim 1 further comprising the step of receiving a first wager from said at least one player that a completed player hand will have a higher poker value than a completed dealer hand.

3. The method of claim 2 further comprising the step of receiving a second wager from said at least one player that a completed player hand will have a higher poker value than a completed dealer hand.

4. The method of claim 3 further comprising the step of limiting an amount of said second wager to an amount equal to one-half of said first wager.

5. The method of claim 3 further comprising the step of paying each said at least one player an amount equal to said second wager when said completed player hand being a winning hand.

6. The method of claim 3 further comprising the step of collecting from each said at least one player at least one of said first wager amount and said second wager amount when said completed dealer hand being a winning hand.

7. The method of claim 2 further comprising the step of paying each said at least one player an amount equal to said first wager when said completed player hand being a winning hand.

8. The method of claim 2 further comprising the step of receiving said first wager from said at least one player in two equal portions, each said two equal portions having a value of one-half said first wager.

9. The method of claim 2 further comprising the step of paying each said at least one player an amount equal to one-half of said first wager when said completed player hand being both a winning hand and said completed player hand failing to achieve a predetermined poker value.

10. The method of claim 9 wherein said predetermined poker value being one of a pair and greater than a pair.

11. The method of claim 2 further comprising the step of permitting a player to be eligible to receive a pre-determined bonus payout if at least one of said completed dealer hand and said completed player hand achieves a pre-determined poker value.

12. The method of claim 11 further comprising the step of receiving a bonus wager from each said at least one player that at least one of said completed dealer hand and said completed player hand will achieve a predetermined poker value.

13. The method of claim 12 further comprising the step of collecting said bonus wager from each said at least one player when at least one of said completed dealer hand and said completed player hand fails to achieve said predetermined poker value.

14. The method of claim 1 wherein said initial predetermined number of cards being six cards and further comprising the steps of:

dealing six initial cards;

assigning said first subgroup having three cards to said dealer as an initial dealer hand; and assigning said remaining three cards not in said first subgroup to at least one player as an initial player hand.

15. The method of claim 14 further comprising the steps of:

dealing said dealer two additional cards;

determining a completed five-card poker hand value of said dealer hand based on said initial dealer hand of three cards and said two additional cards dealt to said dealer;

dealing each said at least one player three additional cards;

determining a completed five-card poker hand value for each said player hand based on said initial player hand of three cards and said three additional cards of each said at least one player;

comparing said completed poker hand value of said dealer hand and each said completed poker hand value of each said player hand, wherein the hand having the higher poker value being a winning hand; and selecting as a winning hand whichever of said dealer hand and each said at least one player hand that has a higher poker value.

16. The method of claim 15 further comprising the step of receiving a first wager from said at least one player that a completed player hand will have a higher poker value than a completed dealer hand.

17. The method of claim 16 further comprising the step of receiving a second wager from said at least one player that a completed player hand will have a higher poker value than a completed dealer hand.

18. The method of claim 17 further comprising the step of limiting an amount of said second wager to an amount equal to one-half of said first wager.

19. The method of claim 17 further comprising the step of paying each said at least one player an amount equal to said second wager when said completed player hand being a winning hand.

20. The method of claim 17 further comprising the step of collecting from each said at least one player at least one of said first wager amount and said second wager amount when said completed dealer hand being a winning hand.

21. The method of claim 16 further comprising the step of paying each said at least one player an amount equal to said first wager when said completed player hand being a winning hand.

22. The method of claim 16 further comprising the step of receiving said first wager from said at least one player in two equal portions, each said two equal portions having a value of one-half said first wager.

23. The method of claim 16 further comprising the step of paying each said at least one player an amount equal to one-half of said first wager when said completed player hand being both a winning hand and said completed player hand failing to achieve a predetermined poker value.

24. The method of claim 23 wherein said predetermined poker value being one of a pair and greater than a pair.

25. The method of claim 16 further comprising the step of permitting a player to be eligible to receive a pre-determined bonus payout if at least one of said completed dealer hand and said completed player hand achieves a pre-determined poker value.

26. The method of claim 25 further comprising the step of receiving a bonus wager from each said at least one player that at least one of said completed dealer hand and said completed player hand will achieve a predetermined poker value.

27. The method of claim 26 further comprising the step of collecting said bonus wager from each said at least one player when at least one of said completed dealer hand and said completed player hand fails to achieve said predetermined poker value.

28. The method of claim 14 further comprising the steps of:

dealing two of said three cards of said first subgroup face-up and one of said three cards of said first subgroup face down; and dealing two of said three cards of said remaining three cards not in said first subgroup face-up and one of said three cards of said remaining three cards not in said first subgroup face down.

29. The method of claim 28 further comprising the steps of:

revealing the face down card of said first hand; and revealing the face down card of said second hand.

30. The method of claim 29 further comprising the steps of:

dealing said dealer two additional cards;

determining a completed five-card poker hand value of said dealer hand based on said initial dealer hand and said two additional cards dealt to said dealer;

dealing each said at least one player three additional cards;

determining a completed five-card poker hand value for each said player hand based on said initial player hand and said three additional cards of each said at least one player;

comparing said completed poker hand value of said dealer hand and each said completed poker hand value of each said player hand of each said at least one player, wherein the hand having the higher poker value being a winning hand; and selecting as a winning hand whichever of said dealer hand and each said at least one player hand that has a higher poker value.

31. The method of claim 28 further comprising the step of receiving a first wager from said at least one player that a completed player hand will have a higher poker value than a completed dealer hand.

32. The method of claim 31 further comprising the step of paying each said at least one player an amount equal to said first wager when said completed player hand being a winning hand.

33. The method of claim 31 further comprising the step of receiving said first wager from said at least one player in two equal portions, each said two equal portions having a value of one-half said first wager.

34. The method of claim 31 further comprising the step of paying each said at least one player an amount equal to one-half of said first wager when said completed player hand being both a winning hand and said completed player hand failing to achieve a predetermined poker value.

35. The method of claim 34 wherein said predetermined poker value being one of a pair and greater than a pair.

36. The method of claim 31 further comprising the step of receiving a second wager from said at least one player that a completed player hand will have a higher poker value than a completed dealer hand.

37. The method of claim 36 further comprising the step of limiting an amount of said second wager to an amount equal to one-half of said first wager.

38. The method of claim 36 further comprising the step of paying each said at least one player an amount equal to said second wager when said completed player hand being a winning hand.

39. The method of claim 36 further comprising the step of collecting from each said at least one player at least one of said first wager amount and said second wager amount when said completed dealer hand being a winning hand.

40. The method of claim 14 further comprising the steps of:

assigning three cards comprised of two cards having a highest poker value of said six initial cards and one card having a lowest poker value of said six initial cards to said dealer as an initial dealer hand; and assigning a remaining three cards of said six initial cards to said at least one player as an initial player hand.

41. The method of claim 14 further comprising the steps of:

dealing said dealer two additional cards;

dealing each said at least one player two additional cards;

permitting said dealer to replace a number of cards previously received;

permitting each said at least one player to replace a number of cards previously received, wherein each said at least one player being permitted to replace a greater number of cards than said dealer;

determining a completed five-card poker hand value of said dealer hand based on said initial dealer hand of three cards and said two additional cards dealt to said dealer and any replacement cards;

determining a completed five-card poker hand value for each said player hand based on said initial player hand of three cards and said three additional cards and any replacement cards of each said at least one player;

comparing said completed poker hand value of said dealer hand and each said completed poker hand value of each said player hand; and selecting as a winning hand whichever of said dealer hand and each said at least one player hand that has a higher poker value.

42. The method of claim 14 wherein comparing said initial poker hand value of said first hand with said initial poker hand value of said second hand being determined whereby any pair has a higher hand value than any three unmatched cards, wherein any three of a kind has a higher hand value than any pair, wherein a higher pair has a higher poker value than a lower pair, wherein a higher three of a kind has a higher poker value than a lower three of a kind, wherein said first hand and said second hand having pairs of equal value a higher third card determines a higher poker hand value, wherein said first hand and said second hand each having three unmatched cards the hand with a highest card has a higher poker value, wherein said first hand and said second hand each having three unmatched cards and said highest card of said first hand and said highest card of said second hand being of equal value then the hand having the second highest card has a higher poker value, wherein said first hand and said second hand each having three unmatched cards and said highest card of said first hand and said highest card of said second hand being of equal value and said second highest card of said first hand and said second highest card of said second hand being of equal value the hand having the third highest card has a higher poker value.

43. The method of claim 1 wherein said completed player hand of each said at least one player being comprised of three cards and wherein said completed dealer hand being comprised of three cards.

44. The method of claim 1 further comprising the steps of:

providing a video gaming machine; and displaying said poker-type card on said video gaming machine.

45. The method of claim 1 wherein said predetermined number of cards of said initial player hand being community cards to be used by each said at least one player and wherein said predetermined number of cards to complete each player hand are dealt individually to each said at least one player and wherein said completed player hand comprises a combination of said community cards of said initial player hand and said predetermined number of cards dealt individually to each said at least one player.

46. The method of claim 14 further comprising the steps of:

receiving a first wager from said at least one player that a completed player hand will have a higher poker value than a completed dealer hand;

dealing said six initial cards into a first hand having three cards face up and a second hand having three cards face down, receiving a second wager from said at least one player that a completed player hand will have a higher poker value than a completed dealer hand;

exposing said face down cards of said second hand face up;

determining an initial poker hand value of said first hand;

determining an initial poker hand value of said second hand;

comparing said initial poker hand value of said first hand with said initial poker hand value of said second hand;

assigning whichever of said first hand and said second hand that has a higher initial poker hand value to a dealer as an initial dealer hand;

assigning whichever of said first hand and said second hand not assigned to said dealer to said at least one player as an initial player hand;

dealing said dealer two additional cards;

determining a completed five-card poker hand value of said dealer hand based on said initial dealer hand of three cards and said two additional cards dealt to said dealer;

dealing each said at least one player three additional cards;

determining a completed five-card poker hand value for each said player hand based on said initial player hand of three cards and said three additional cards of each said at least one player;

comparing said completed poker hand value of said dealer hand and each said completed poker hand value of each said player hand;

selecting as a winning hand whichever of said dealer hand and each said at least one player hand that has a higher poker value;

paying each said at least one player an amount equal to said first wager when said completed player hand being a winning hand;

paying each said at least one player an amount equal to said second wager when said completed player hand being a winning hand; and collecting from each said at least one player at least one of said first wager amount and said second wager amount when said completed dealer hand being a winning hand.

47. A method of playing a poker-type card game comprising, in combination, the steps of:

dealing an initial predetermined number of cards;

identifying a first subgroup of said predetermined number of cards having a relatively high poker value as compared to a remaining number of said predetermined number of cards not in said first subgroup;

assigning said first subgroup having a higher poker value to at least one player as an initial player hand;

assigning said remaining number of said predetermined number of cards not in said first subgroup to a dealer as an initial dealer hand;

dealing a predetermined number of cards to said dealer to complete said dealer hand;

conveying a predetermined poker advantage to said predetermined number of cards dealt to said dealer to complete said dealer hand relative to said predetermined number of cards dealt to said at least one player to complete each said at least one player hand, wherein said poker advantage being at least one of a greater number of cards, cards having a higher poker value, and said dealer having a selection choice of said cards;

comparing said completed poker hand value of said completed dealer hand with said completed poker hand value of each said completed player hand of each said at least one player; and selecting as a winning hand whichever of said dealer hand and each said at least one player hand that has a higher poker value.

48. A method of playing a combination blackjack and poker-type card game comprising, in combination, the steps of:

dealing at least one player blackjack hand to at least one player;

dealing a dealer blackjack hand to a dealer;

comparing said at least one player blackjack hand to said dealer blackjack hand;

selecting as a winning hand whichever of said dealer blackjack hand and each said at least one player blackjack hand that has a higher blackjack value;

one of dealing, removing and not dealing at least one card to said at least one player blackjack hand to achieve a first initial poker hand of three cards;

one of dealing, removing and not dealing at least one card to said dealer blackjack hand to achieve a second initial poker hand of three cards;

comparing said initial poker hand value of said first hand with said initial poker hand value of said second hand;

assigning whichever of said first hand and said second hand that has a higher initial poker hand value to a dealer as an initial dealer hand;

assigning whichever of said first hand and said second hand not assigned to said dealer to said at least one player as an initial player hand;

dealing said dealer two additional cards to complete said dealer hand;

determining a completed five-card poker hand value of said dealer hand based on said initial dealer hand of three cards and said two additional cards dealt to said dealer;

dealing each said at least one player additional cards to complete said player hand;

conveying a predetermined poker advantage to said predetermined number of cards dealt to said at least one player to complete each said at least one player hand relative to said predetermined number of cards dealt to said dealer to complete said dealer hand, wherein said poker advantage being at least one of a greater number of cards, cards having a higher poker value, and said at least one player having a selection choice of said cards;

comparing said completed poker hand value of said completed dealer hand with said completed poker hand value of each said completed player hand of each said at least one player; and selecting as a winning hand whichever of said dealer hand and each said at least one player hand that has a higher poker value.

* * * * *

UNITED STATES PATENT AND TRADEMARK OFFICE

CERTIFICATE OF CORRECTION

PATENT NO. : 6,959,928 B2 
APPLICATION NO. : 10/712501
DATED : November 1, 2005
INVENTOR(S) : Schultz It is certified that error appears in the above-identified patent and that said Letters Patent is hereby corrected as shown below:

Column 21, lines 59-60, after the language "dealing a predetermined number of cards to said dealer to complete said dealer hand" and before "conveying a predetermined poker advantage to said predetermined number of cards dealt to said dealer to complete said dealer hand relative to said predetermined number of cards dealt to said at least one player to complete each said at least one player hand" in Column 21, line 61 to Column 22, lines 1-2, insert the following --dealing a predetermined number of cards to said at least one player to complete each said at least one player hand.--

Signed and Sealed this

Third Day of April, 2007

JON W. DUDAS
*Director of the United States Patent and Trademark Office*